United States Patent [19]

Schulz

[11] 4,148,475

[45] Apr. 10, 1979

[54] SHEET SORTING DEVICE

[75] Inventor: Leo J. Schulz, St. Paul, Minn.

[73] Assignee: Minnesota Mining and Manufacturing Company, St. Paul, Minn.

[21] Appl. No.: 824,251

[22] Filed: Aug. 12, 1977

[51] Int. Cl.[2] ..... B65H 31/24; B65H 31/22

[52] U.S. Cl. ..... 271/173; 211/50; 248/405; 271/213

[58] Field of Search ..... 271/173, 64, 213; 270/58; 211/50; 248/405, 406; 312/281, 313

[56] References Cited

U.S. PATENT DOCUMENTS

| | | | |
|---|---|---|---|
| 615,636 | 12/1898 | Regensteiner | 271/173 X |
| 3,561,754 | 2/1971 | Gaffron et al. | 271/173 |
| 3,848,995 | 11/1974 | Gauronski | 270/58 X |
| 3,988,018 | 10/1976 | Tusso et al. | 271/173 |
| 3,995,748 | 12/1976 | Looney | 271/173 X |

*Primary Examiner*—Bruce H. Stoner, Jr.

*Attorney, Agent, or Firm*—Cruzan Alexander; Donald M. Sell; William L. Huebsch

[57] ABSTRACT

A device adapted to receive sheets serially from a machine and sort the sheets in a predetermined manner. The device includes a receiver portion movable relative to the machine to position any one of a number of shelves in the receiver portion to receive a sheet discharged by the machine. A threaded rod fixed along one side of the receiver portion and axially slidably engaged in bearings, together with relativey slidable portions of a latch assembly on the other side of the receiver provide means for guiding movement of the receiver portion. A nut threadably engaging the rod and fixed against axial movement may be rotated by a drive mechanism to move the receiver portion in a predetermined pattern, thereby causing a desired sorting of sheets in its shelves. By releasing the latch the receiver portion may be pivoted about the rod away from the machine to afford clearing or servicing mechanisms therebetween.

4 Claims, 3 Drawing Figures

SHEET SORTING DEVICE

BACKGROUND OF THE INVENTION

This invention relates to devices for receiving sheets fed serially into the device and for sorting those sheets in a predetermined manner in shelves of a receiver portion of the device; and in one important aspect to such devices adapted to be included with or mounted on a machine feeding the sheets to the device.

The art is replete with devices for sorting sheets in a predetermined pattern. Of such known devices, that taught in U.S. Pat. No. 3,561,754 is specially noted. That device includes a fixed portion adapted to be attached to an office copy machine adjacent its copy discharge mechanism, means on the fixed portion for directing a sheet discharged by the copy machine along a predetermined path, a receiver portion comprising a plurality of spaced shelves movably mounted on the fixed portion to afford alignment of any one of the shelves to receive sheets moving along the path, and means for moving the receiver portion in a predetermined pattern to make a desired distribution in its shelves of sheets serially discharged by the copy machine.

While the device taught in U.S. Pat. No. 3,561,754 is servicable, it is relatively expensive and its mechanism for driving the trays along the fixed portion does not function as quickly or smoothly as might be desired. More importantly, with the device in place it is difficult to clear the occasional misdirected sheet from between the fixed portion and receiver portion of the device.

SUMMARY OF THE INVENTION

A device according to the present invention is of a simple design, and therefore relatively inexpensive, while still providing fast, efficient and versatile sorting of sheets received serially from a machine (such as an office copy machine). The device may be associated with, attached to or incorporated as a part of the machine while still affording ready access for an operator to sheet discharge mechanisms of the machine or interfaces between portions of the device to clear away any misdirected sheets that may be present or to otherwise service the device.

Like the device of U.S. Pat. No. 3,561,754 the present invention is a device for receiving sheets discharged serially from a machine, and for sorting the sheets in a predetermined manner in the shelves of a receiver portion of the device. The device includes a fixed portion which can be included in or attached to the machine, means on the fixed portion for directing sheets discharged from the machine along a predetermined path, means for mounting the receiver portion on the fixed portion to afford alignment of any one of the shelves with said predetermined path, and means for moving the receiver portion in a predetermined pattern to achieve a desired distribution of sheets in its shelves.

Unlike that prior art device, however, the means for mounting the receiver portion on the fixed portion comprises spaced bearings fixed on one of the portions; and a rod with a threaded end portion, which rod is fixed against longitudinal movement relative to the other of the portions. The rod is positioned along one side of the receiver portion, is aligned axially parallel to the desired direction of travel of the receiver portion, and extends through the bearings to afford relative sliding movement between the rod and bearings longitudinally of the rod. Also included is a latch assembly including one part mounted on the fixed portion and another part on the receiver portion. The parts of the latch assembly are relatively slidable and aligned to afford, together with relative sliding movement between the rod and the bearings, movement of the shelves relative to the fixed portion. The parts of the latch assembly are also releasable to allow the receiver portion to be pivoted away from the fixed portion around the rod, thereby providing access to the area therebetween.

The means for moving the receiver in a predetermined pattern comprises a nut threadably engaging the threaded end portion of the rod. The nut is rotatably mounted but constrained against axial movement relative to the bearings, and a drive means can cause relative rotational movement between the nut and rod and thereby movement of the receiver portion along the fixed portion.

This design provides a smooth and efficient drive to move the receiver portion, and by simply releasing the latch assembly and swinging the receiver portion away, access to the area between the fixed and receiver portions to clear a misdirected sheet from therebetween or to otherwise service the device.

Additionally where the device is adapted to be attached to a machine, the means for directing a sheet along a predetermined path (which may be a conveyor for receiving a sheet discharged by the machine and for directing the sheet along the predetermined path) may be mounted on a part of the fixed portion which is supported on the machine by bearings engaging the shaft. This part of the fixed portion is normally retained adjacent the dicharge mechanism by a latch which, when released allows the part of the fixed portion to also pivot about the shaft and swing away from the machine, thereby affording access to the conveyor inlet and the sheet discharge mechanism of the machine.

BRIEF DESCRIPTION OF THE DRAWING

The above and added advantage of the present invention will be better understood after reading the following detailed description which refers to the accompanying drawing wherein like numbers refer to like parts in the several views, and wherein.

DESCRIPTION OF THE PREFERRED EMBODIMENT

Figure 1:
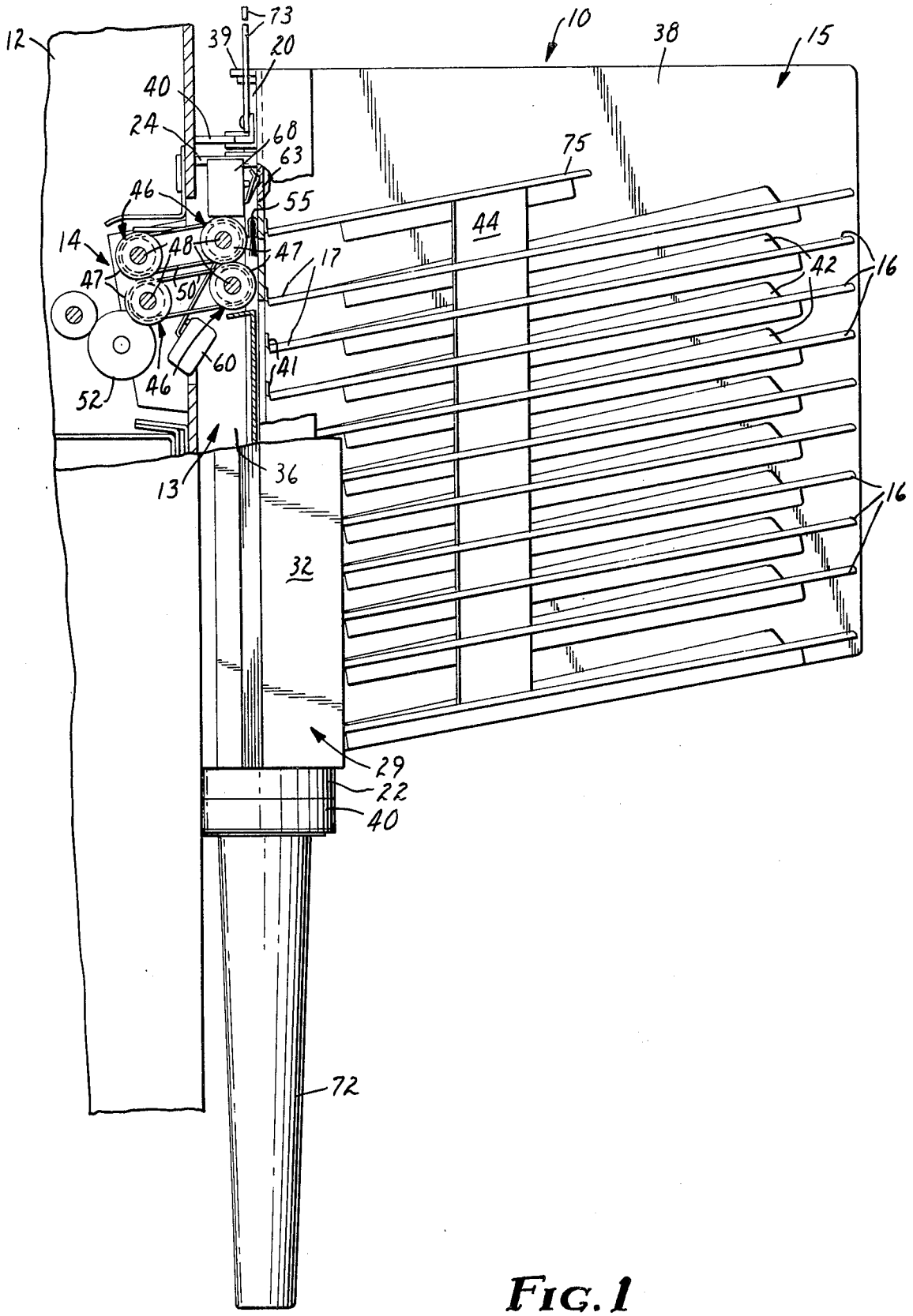
FIG. 1 is a front elevational view having parts broken away to show details which illustrates a sheet sorting device according to the present invention and a fragment of a machine to which the device is attached.

Referring now to the drawing there is illustrated a sheet sorting device according to the present invention generally designated by the reference numeral 10. The device 10 is shown attached to a fragment of a machine 12 including means for feeding sheets serially to the device 10 such as the copy machine designated the "Secretary III" and available from Minnesota Mining and Manufacturing Co. of St. Paul, Minn.

Generally the device 10 comprises a fixed portion 13 which may be combined with or adapted to be mounted on the frame of the machine 12, a sheet conveyor 14 on the fixed portion 13 which provides means for receiving sheets discharged from the machine 12 and directing the sheets along a predetermined path, and a receiver portion 15 comprising a plurality of parallel shelves 16 with aligned inlet ends 17. The device 10 also includes means for movably mounting the receiver portion 15 on the fixed portion 13 to afford alignment of any one of the inlet ends 17 of the shelves 16 with a discharge end of the conveyor 14 and means for moving the receiver portion 15 in a predetermined pattern relative to the fixed portion 13 to achieve a desired distribution of sheets in the shelves 16.

Figure 2:
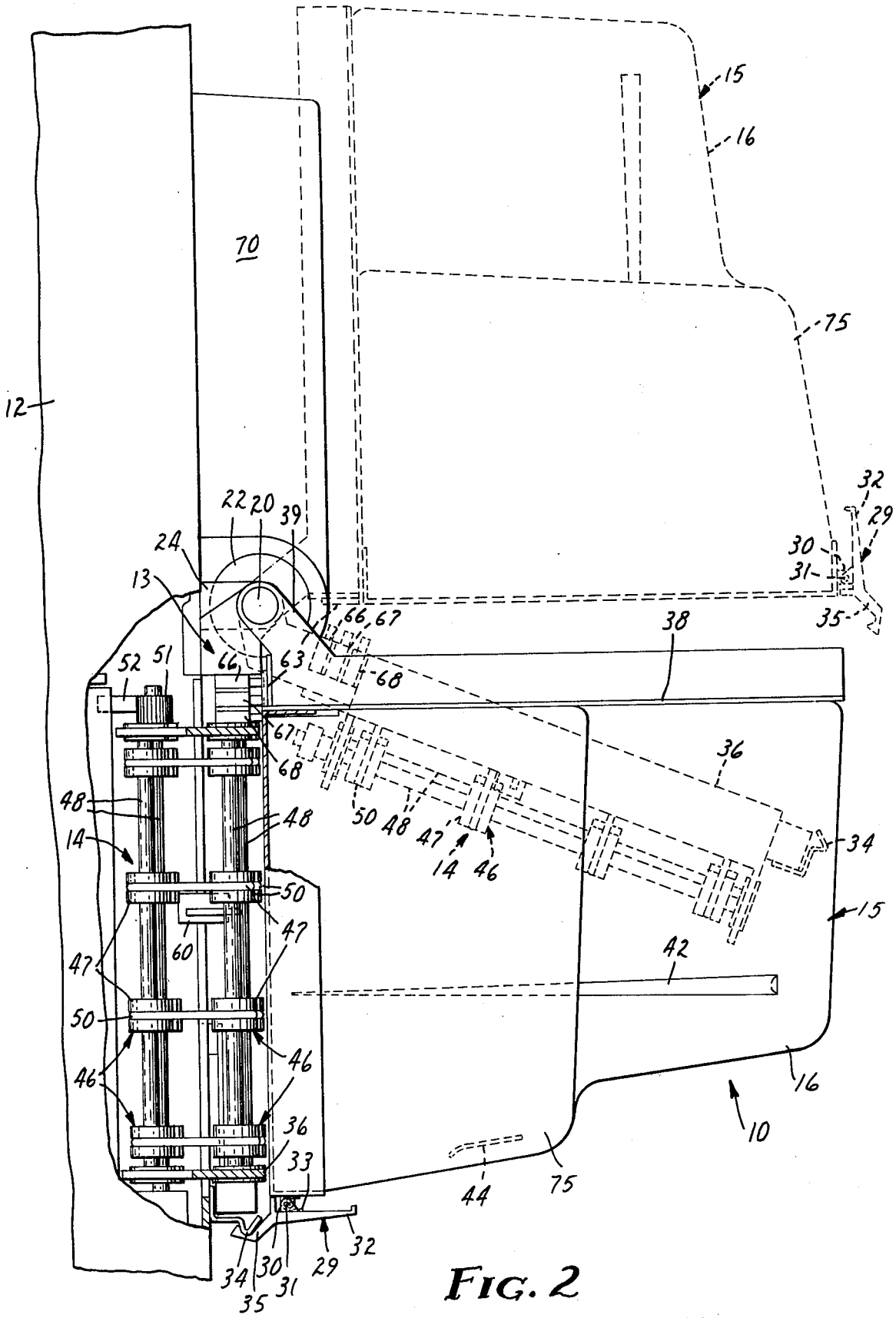
FIG. 2 is a top view of the device and copy machine fragment of FIG. 1 which has parts broken away to show details and also illustrates in phantom outline movement of certain portions of the device with respect to the copy machine.
Figure 3:
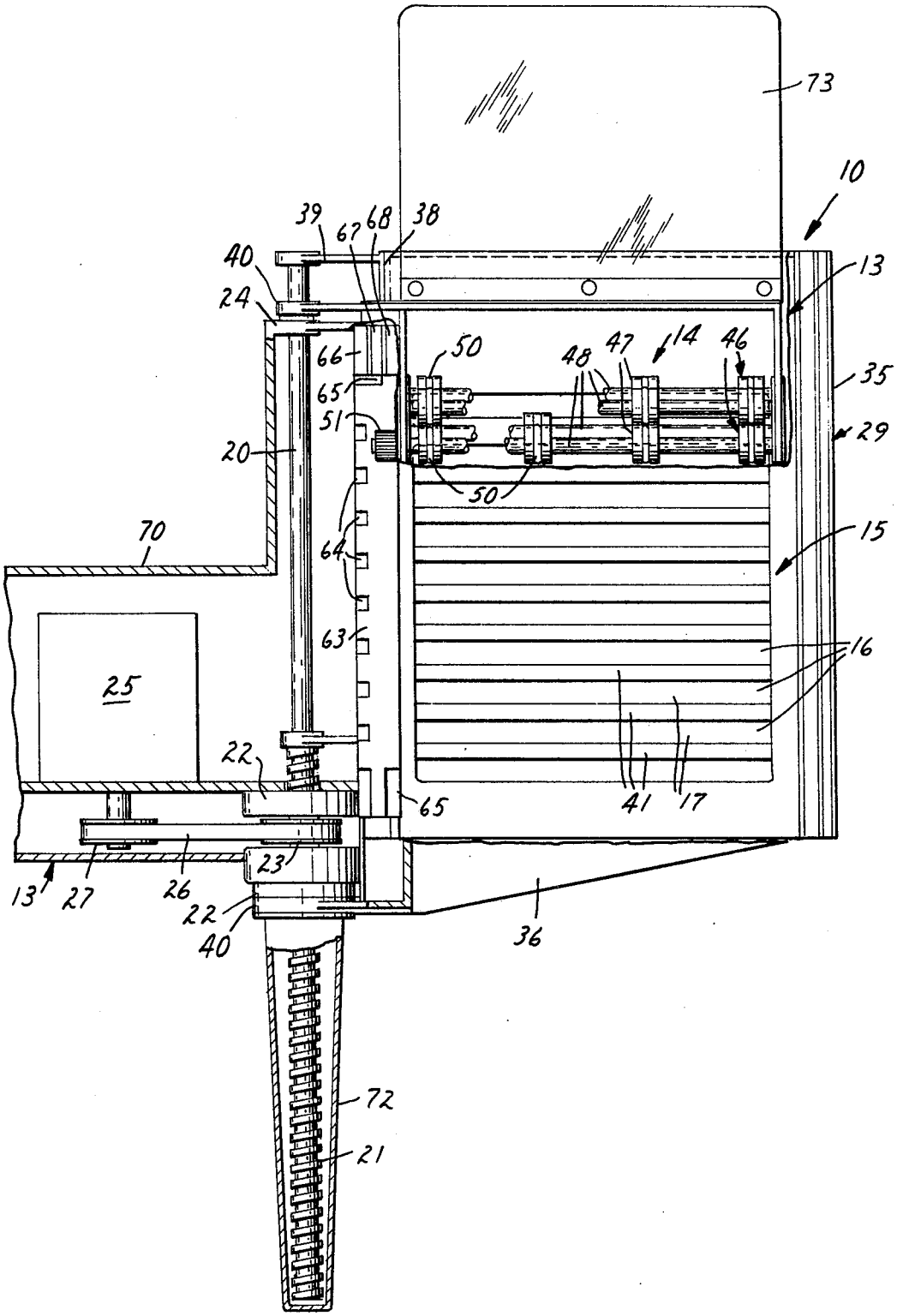
FIG. 3 is a reduced elevational view having parts broken away to show details of the device of FIG. 1 from the side of the device adjacent the copy machine.

The means for movably mounting the receiver portion 15 on the fixed portion 13 to afford alignment of any one of the shelves 16 with the conveyor 14 and the means for moving the receiver portion 15 relative to the frame portion 13 both include a cylindrical shaft or rod 20 having a threaded end portion 21. The rod 20 is fixed to one side of the receiver portion 15 and is aligned axially parallel with the ends 17 of the shelves 16. A pair of spaced bearings 22 are fixed to the machine 12 and rotatably support a nut 23 therebetween while restraining the nut 23 against axial movement. The nut 23 threadably engages and supports the threaded end portion 21 of the rod 20, whereas the unthreaded end portion of the rod 20 is rotatably and slidably supported in a bearing on an arm 24 also fixed to the machine 12. Axial movement of the rod 20 in either direction to move the receiver portion 15 relative to the frame portion 13 can be caused by rotation of the nut 23 via a reversible motor 25 and a timing belt 26 engaging a pulley 27 on the motor shaft and the periphery of the nut 23. The means for movably mounting the receiver portion 15 on the fixed portion 13 also includes a latch assembly 29. The latch assembly 29 comprises a first part or keeper 34 fixed along the side of the fixed portion 13, and a second part or plate 32. The plate 32 is mounted on spaced projections 30 on the side of the receiver portion 15 by a pin 31 for pivotable movement between (1) an engaged position (shown in solid outline in FIG. 2) to which the plate 32 is biased by springs 33 at which mating parallel channel-like portions 35 of the plate 32 and keeper 34 are engaged and are relatively longitudinally slidable in a direction parallel to the rod 20 to afford movement of the ends 17 of the shelves 16 adjacent the outlet end of the conveyor 14; and (2) a disengaged position at which the parts 32 and 34 of the latch assembly may be separated and the receiver 15 may be pivoted around the rod 20 away from its normal position adjacent the fixed portion 13 to positions such as that shown in phantom outline in FIG. 2 to afford access to their normally facing surfaces.

A part 36 of the fixed portion 13 on which the conveyor 14 is mounted is also supported from and mounted by spaced bearings 40 for pivotal movement around the rod 20 from a normal position (shown in solid in FIG. 2) at which it is normally maintained by a latch assembly (not shown) releasably engageable between it and the machine 12; and positions spaced from the machine 12 (one of which is shown in phantom outline in FIG. 2) which afford access to the inner parts of the machine 12 and the conveyor 14.

The receiver portion 15 includes a support plate 38 fixed to the rod 20 by brackets 39. The shelves 16 are attached along one end to the support plate 38 in parallel spaced relationship and are inclined upwardly from their inlet ends 17. The inlet ends 17 of the shelves each have an upwardly turned lip 41 over which sheets are propelled into the shelf 16 by the conveyor 14. A sheet propelled into one of the upwardly inclined shelves 16 will settle against its lips 41 under the influence of gravity and be retained thereby within the shelf 16. Also, each shelf 16 has a rib 42 aligned with and increasing in height in the direction of movement of paper into the shelf 16. The rib 42 on each shelf 16 is positioned to cause sheets coming into the shelf 16 to bend longitudinally over the rib 42, thereby causing the sheets to stack more smoothly. The receiver 15 also includes an arcuate guide plate 44 on its side opposite the support plate 38 which insures that sheets will not be slid sidewise out of the shelves 16. Each shelf 16 is open and relieved along its outer edge opposite the support plate 38 to facilitate manual removal of sheets.

The conveyor 14 comprises two horizontally spaced pairs of nipping roller assemblies 46, with the roller assemblies 46 in each pair spaced one above the other. Each of the roller assemblies 46 comprises four axially spaced rollers 47 of a soft polymeric material such as urethane mounted on a common shaft 48. The two lower roller assemblies 46 are rotatably mounted in fixed positions on the fixed portion 13, whereas the two upper roller assemblies 46 are rotatably mounted in bearings which are vertically slidable for a short distance upwardly on the fixed portion 13 from a position with the adjacent roller assemblies 46 contacting each other. Thus sheets passing therebetween can separate the roller assemblies 46, while the weight of the upper assemblies 46 biases them into engagement with such sheets. Between grooves in the adjacent rollers 47 of the upper two roller assemblies 46 and between grooves in the adjacent rollers 47 of the lower two roller assemblies 46 are trained O-ring belts 50 which serve both to direct sheets through the conveyor 14 and to provide driving engagement between the connected roller assemblies 46. Means for driving the conveyor 14 is provided by a knurled projecting end 51 of the shaft 48 on the lower roller assembly 46 adjacent the machine 12. When the part 36 of the fixed portion on which the conveyor 14 is mounted is in its normal position, the end 51 is pressed into contact with a roller 52 in the copy machine 12, which roller 52 is driven by the machine's sheet discharging mechanism. The knurled end 51 will separate from the roller 52 when the part 36 is unlatched and pivoted away from its normal position.

A brush 55 comprising fine conductive carbonaceous fibers is mounted on the fixed portion 13 in a position at which the fibers will contact sheets passing through the conveyor 14 to remove static electrical charges therefrom. The brush 55 and its preferred method of manufacture are described in U.S. Pat. Nos. 3,757,164 and 3,689,117, the contents whereof are incorporated herein by reference.

In addition to the mechanical portions of the means for moving the receiver in a predetermined pattern described above, that means also comprises a conventional control circuit (not shown) which can be set to one of several modes. These modes include a non-sorting mode in which the receiver portion 15 remains in one position and all sheets ejected by the machine are positioned in one of its shelves 16. Also included is a collate mode in which the receiver portion 15 starts in its lowest position and is stepped upwardly to move the next lower shelf 16 into alignment with the outlet of the conveyor 14 after each copy is positioned in the receiver portion 15. Additionally a progressive sort mode could be used in which the receiver portion 15 is stepped after any number of copies of each original are placed in one of the shelves 16, as would be desirable to separate copies of single sheet documents having no relationship to each other.

For any mode where stepping of the receiver portion 15 is desired, the circuitry involved employs a microswitch 60 at the conveyor 14 which senses sheets passing through and at the appropriate time will activate the motor 25 to advance the receiver portion 15. Also included is a cam strip 63 attached to the receiver portion 15 which has relieved areas 64 spaced to correspond to the spacing of the shelves 16 and will move adjacent and operate a switch 66 on the fixed portion 13 to stop the motor 25 when the next shelf 16 is aligned at the conveyor 14. The cam strip 63 may also have relieved areas 65 at its end cooperating with other switches 67 and 68 on the fixed portion 13 to indicate upper and lower limits for the receiver portion 15.

Preferably the device 10 also includes certain protective safety members including a cover 70 over the drive mechanism and a protective cup 72 over the threaded end portion 21 of the rod 20 projecting from the nut 23. A sheet 73 upwardly projecting from the fixed portion 13 is also provided to preclude engagement between the inlet ends 17 of the shelves 16 when the receiver portion 15 is raised, which could be particularly dangerous when the receiver portion 15 is moving downwardly. Also a protective plate 75 is placed over the top shelf 16 to restrict contact between a user and the conveyor through the inlet end 17 of the top shelf 16.

While the device 10 is one preferred embodiment, many changes could be made therein without departing from the spirit of the invention. For example, the rod could be fixed against axial movement on the fixed portion, and the bearings could be mounted on the receiver portion with the nut fixed against axial movement relative to the bearings. With this arrangement either the nut or the rod can be fixed against rotation and the other rotated to provide relative rotational movement therebetween and drive the receiver portion. Thus the scope of the invention should not be limited by the structure of the preferred embodiment described herein, but only by the language of the dependent claims.

I claim:

1. In a device adapted for use with an office copy machine to distribute sheets in a predetermined manner, said device comprising:

a fixed portion adapted to be attached to a copy machine adjacent its copy discharge mechanism;

means mounted on said fixed portion for receiving a sheet discharged by the copy machine and for directing the sheet along a predetermined path;

a receiver portion comprising a plurality of spaced shelves each having an inlet end with the inlet ends of said shelves being aligned in a row and being open so that sheets may enter any one of said shelves through said inlet ends;

means mounting the receiver portion on said fixed portion to afford alignment of any one of said inlet ends of the shelves with said means for directing; and means for moving said receiver portion in a predetermined pattern with respect to said means for directing to provide a distribution of sheets in said shelves;

the improvement wherein said means for mounting comprises a rod fixed to said receiver portion along one side and aligned axially parallel to the inlet ends of said trays and having a threaded end portion, bearings mounted on said fixed portion and receiving said rod to afford longitudinal sliding movement of said rod, a latch assembly including a first part on said fixed portion and a second part on said receiver portion, said parts being relatively slidable to afford, with sliding movement of said rod in said bearings, movement of said shelves relative to said fixed portion to afford alignment of any one of the inlet ends of the shelves with said means for directing, said parts being releasable to allow said receiver portion to be pivoted away from said fixed portion around said rod, thereby providing access to the area therebetween; and said means for moving comprises a nut threadably engaged with the threaded end portion of said rod, said nut being mounted for rotation and fixed against axial movement relative to said fixed portion, and means for rotating said nut to move said rod and thereby said receiver portion relative to said fixed portion.

2. A device according to claim 1, wherein said means for receiving and directing a sheet is mounted on a part of said fixed portion which is pivotable about said rod away from a said machine on which said device is mounted to afford access to internal areas of the machine.

3. In combination, a machine including means for serially ejecting sheets and a device for sorting said sheets, said combination including:

a fixed portion;

means for directing ejected copies along a predetermined path relative to said fixed portion;

a receiver portion comprising a plurality of spaced shelves each having an inlet end with the inlet ends of said shelves being aligned in a row and being open so that sheets may enter any one of said shelves through said inlet ends;

means for mounting said receiver portion on said fixed portion to afford alignment of any one of the inlet ends of the shelves with said means for directing, said means for mounting comprising spaced bearings fixed on one of said portions and a rod fixed against longitudinal movement relative to the other, said rod being positioned along one side of said receiver, having a threaded end portion and extending through said bearings to afford relative sliding movement between said rod and bearings longitudinally of said rod; and a latch assembly including one part on said fixed portion and another part on said receiver portion, said parts being relatively slidable to afford, with sliding movement of said rod in said bearings, movement of said shelves relative to said fixed portion, and being releasable to allow said receiver portion to be pivoted away from said fixed portion around said rod, thereby providing access to the area therebetween; and means for moving said receiver portion in a predetermined pattern with respect to said means for directing to distribute sheets in said receiver portion, comprising a nut threadably engaged with the threaded end portion of said rod, said nut being mounted for rotation and fixed against axial movement relative to said bearings, and means for causing rotational movement of said nut and rod relative to each other to cause relative axial motion between said nut and rod and thereby move said receiver portion relative to said fixed portion.

4. A device adapted for use with a machine including means for serially ejecting sheets to distribute the sheets in a predetermined manner, said device comprising:

a fixed portion adapted to be attached to a said machine adjacent its means for ejecting;

means on the fixed portion for receiving a sheet ejected by said means for ejecting and for directing the sheet along a predetermined path;

a receiver portion comprising a plurality of spaced shelves each having an inlet end with the inlet ends of said shelves being aligned in a row and being open so that sheets may enter any one of said shelves through said inlet ends;

means for movably mounting said receiver portion on said fixed portion to afford alignment of any one of the inlet ends of the shelves with said means for directing, said means for mounting comprising spaced bearings fixed on one of said portions and a rod fixed against longitudinal movement relative to the other of said portions, said rod being positioned along one side of said receiver, having a threaded end portion and extending through said bearings to afford relative sliding movement between said rod and bearings longitudinally of said rod; and a latch assembly including one part on said fixed portion and another part on said receiver portion, said parts being relatively slidable to afford, with sliding movement of said rod in said bearings, movement of said shelves relative to said fixed portion, and being releasable to allow said receiver portion to be pivoted away from said fixed portion around said rod, and thereby providing access to the area therebetween; and means for moving said receiver portion in a predetermined pattern with respect to said means for directing to distribute sheets in said receiver portion, comprising a nut threadably engaged with the threaded end portion of said rod, said nut being mounted for rotation and fixed against axial movement relative to said bearings, and means for causing relative rotational movement between said nut and rod to cause relative motion between said nut and rod and thereby move said receiver portion along said fixed portion.

* * * * *